United States Patent [19]

Motobayashi et al.

[11] 4,022,007

[45] May 10, 1977

[54] COOLING MEANS FOR RINGLESS SPINNING FRAME

[75] Inventors: Kozo Motobayashi, Aichi; Kazuo Kamiya, Nishio, both of Japan

[73] Assignee: Kabushiki Kaisha Toyoda Jidoshokki Seisakusho, Kariya, Japan

[22] Filed: Mar. 28, 1975

[21] Appl. No.: 562,931

[30] Foreign Application Priority Data

| | | |
|---|---|---|
| Apr. 15, 1974 | Japan | 49-42412 |
| Apr. 16, 1974 | Japan | 49-42950[U] |
| Apr. 17, 1974 | Japan | 49-43278[U] |

[52] U.S. Cl. ..... 57/58.95; 57/34 R; 57/106

[51] Int. Cl.[2] ..... D01H 13/28

[58] Field of Search ..... 57/1 R, 34 R, 36, 58.89–58.95, 57/90, 106

[56] References Cited

UNITED STATES PATENTS

| | | | |
|---|---|---|---|
| 3,070,948 | 1/1963 | Tsuzuki | 57/36 |
| 3,469,385 | 9/1969 | Tsuzuki | 57/34 R |
| 3,564,829 | 2/1971 | Tsuzuki | 57/34 R X |
| 3,774,382 | 11/1973 | Bartling | 57/34 R X |
| 3,782,095 | 1/1974 | Bures et al. | 57/1 R X |
| 3,807,157 | 4/1974 | Stablecker | 57/58.89 |
| 3,816,991 | 6/1974 | Takeuchi et al. | 57/36 |
| 3,837,154 | 9/1974 | Stablecker | 57/58.89 |

*Primary Examiner*—Richard C. Queisser
*Assistant Examiner*—Charles Gorenstein
*Attorney, Agent, or Firm*—Wenderoth, Lind & Ponack

[57] ABSTRACT

A ringless spinning frame comprises a spinning frame body, above which a plurality of sliver cans are disposed on a platform, and a plurality of spinning units attached to the spinning frame body. A sliver from each sliver can is guided by a sliver guide conduit, which is disposed between the corresponding sliver can and spinning unit, to the corresponding spinning unit. The sliver guide conduits extend downwardly behind the corresponding spinning units and within the spinning frame body the interior of which reaches a temperature higher than that of the exterior by about 10° to 20° Celsius. To prevent the sliver guide conduits within the spinning frame body from being raised in temperature, the ringless spinning frame is provided with a device disposed near the sliver guide conduits for preventing heat produced in the spinning frame body from being transmitted to the sliver guide conduits.

8 Claims, 8 Drawing Figures

COOLING MEANS FOR RINGLESS SPINNING FRAME

BACKGROUND OF THE INVENTION

This invention relates to a ringless spinning frame, wherein a sliver is taken up from each of a plurality of sliver cans disposed above a body of the spinning frame and fed through a sliver guide conduit into the spinning frame body from the back side of the corresponding spinning unit.

Heretofore, in order to provide very large packaged cans and to smoothly supply a sliver from each can, disposed above a body of a spinning frame, to a corresponding spinning unit without applying strong tension to the sliver, it has been proposed to provide the spinning frame with a sliver guide conduit, one for each sliver, which extends downwardly from near the sliver can into the spinning frame body and passes therethrough along the back of the corresponding spinning unit and opens at a position below the spinning unit. A ringless spinning frame of this type is described in U.S. Pat. No. 3,816,991 entitled "Method and Device for Supplying Sliver to A Spinning Machine" and assigned to the same assignee as the present application.

With this type of ringless spinning frame, the body is normally covered to arrest noise, and therefore the interior thereof is raised in temperature due to heat produced in the spinning units when components of the spinning unit, such as, a rotor, a spindle and a belt, are driven at high speed. The produced heat would cause a temperature difference in the order of about 10° to 20° C between the interior and the exterior of the spinning frame body. With respect to the sliver fed within the sliver guide conduit, for example, in the case of 20 counts, it takes about 6 minutes to pass through the guide conduit portion within the spinning frame body. Therefore, during this time period, the sliver moving in the guide conduit will be heated due to the high temperature of the frame body interior. This causes moisture in the sliver to be evaporated and therefore the sliver becomes over dried, resulting in a poor quality of spun yarn, and especially in a decreased yarn strength.

Furthermore, it is to be noted that the sliver as well as air having a low temperature, which is substantially equal to that of the spinning frame exterior, will be fed into the sliver guide conduit. This causes a temperature of the outer surface of the guide conduit portion within the spinning frame body to be decreased and air surrounding the outer surface to attain its dew point due to the high temperature of the body interior, thereby providing water drops on the outer surface of the guide conduit. Apparently, the water drops have bad influences upon structures within the spinning frame body.

SUMMARY OF THE INVENTION

It is accordingly a principal object of the invention to provide a ringless spinning machine of the type described, which can eliminate the aforementioned disadvantages of the prior art spinning machine and produce a good quality of spun yarns.

With this object in view, the invention includes a ringless spinning frame comprising a spinning frame body, a plurality of spinning units mounted on both the sides of the spinning frame body, a plurality of sliver cans disposed above the spinning frame body, and a plurality of sliver guide conduits disposed between the corresponding sliver cans and the corresponding spinning units, each guide conduit extending downwardly into the spinning frame body and passing therethrough along the back and bottom of the corresponding spinning unit and opening into the exterior of the spinning frame body at a position below the bottom of the corresponding spinning unit. The spinning frame has therein disposed near the guide conduits within the spinning frame body, means for preventing heat produced by the spinning units from being transmitted to the guide conduits within the spinning frame body.

BRIEF DESCRIPTION OF THE DRAWINGS

The invention will become more readily apparent from the following description of preferred embodiments thereof shown, by way of example only, in the accompanying drawings, wherein.

DESCRIPTION OF THE PREFERRED EMBODIMENTS

Figure 1:
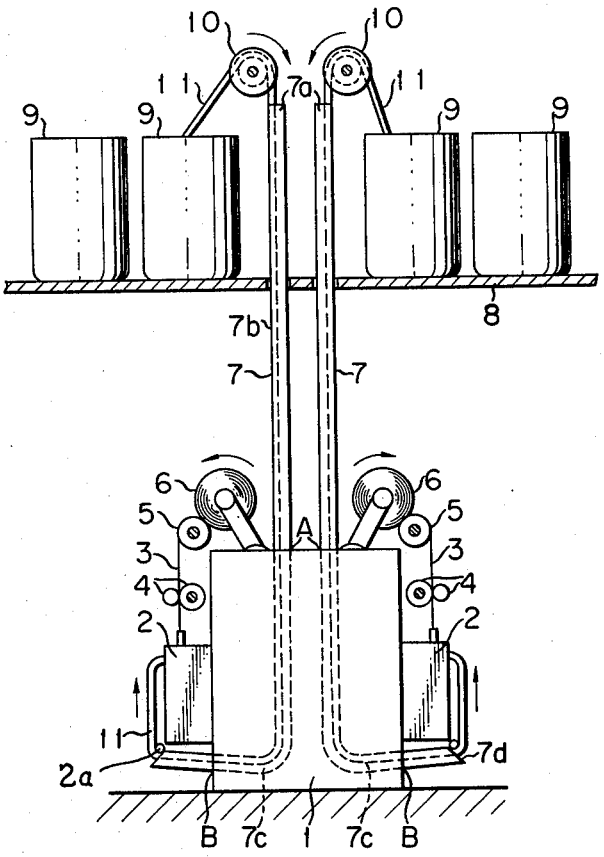
FIG. 1 is a schematic side view of a ringless spinning frame within which the invention can be embodied.

Referring now to the drawings wherein like reference characters designate like or corresponding parts throughout the several views, there is shown in FIG. 1 a ringless spinning frame, in which the invention can be embodied. A plurality of large packaged sliver cans 9 are arranged on a platform 8 formed above a spinning frame body 1. The sliver cans 9 are arranged at positions corresponding to dispositions of spinning units 2 mounted on both the sides of the frame body 1. A sliver guide conduit 7 is disposed at a position corresponding to each spinning unit 2.

Each sliver guide conduit 7 comprises an upright portion **7*b* provided with a top aperture 7*a*, a substantially horizontal portion 7 *c* provided with a bottom aperture 7*d* at a position just below a stationary guide rod 2*a* of the spinning unit 2, and a curved portion connecting the upright portion 7*b* with the horizontal portion 7 *c*. The upright portion 7*b* of the conduit 7 passes through the platform 8 and extends downward to a bottom portion of the spinning unit 2 along a backside of the spinning unit 2. The horizontal portion 7*c* passes below the spinning unit 2**.

The horizontal portion **7*c* of the conduit 7 is preferably inclined slightly upward from the connecting portion so that a resistance to excess output of sliver from the bottom aperture 7*d* of the conduit 7** is created.

A sliver take up device provided with a take up roller 10 is disposed just above the top aperture **7*a* of sliver guide conduit 7. This take up roller 10 is positively driven by a driving means (not shown) at a higher peripheral speed than the feed speed of a feed roller (not shown) of each spinning unit 2. A suitable driving mechanism may be utilized as the above-mentioned driving means, such as for example a chain drive mechanism which transmits the driving power of a not shown main driving motor of the spinning machine to the take up rollers 10, or a driving mechanisms provided with a certain reduction gear mechanism driven by a separate motor (not shown) disposed on the platform 8. However, in the both cases, it is essential to positively drive the take up roller at a particular peripheral speed as mentioned above. If the take up roller 10 is turnably mounted on a supporting shaft thereof and resistance to the turning of the roller 10 about the shaft is very low, it is possible to take up the sliver from the sliver cans 9 by the weight of sliver in the sliver guide conduit 7** only.

A yarn 3 produced by each spinning unit 2 is taken up by a pair of take up rollers 4 and is wound as a yarn package 6 by means of a winding roller 5. Consequently, a sliver 11 contained in the cans 9 is taken up from the cans 9 by the take up roller 10 and then fed into the sliver guide conduit 7 through the top aperture 7*a*. When the sliver 11 is taken up by the roller 10, the sliver 11 is introduced into an annular guide groove of the roller 10 in such a way that the sliver 11 is belted thereon. Consequently, the sliver 11 is displaced together with the contact surface of the groove of the roller 10 which is positively driven. The sliver 11, which is introduced into the sliver guide conduit 7 from the top aperture 7*a*, is then moved downward through the upright portion 7*b* of the conduit 7, and further moved through the horizontal portion 7*c* and finally taken up from the bottom aperture 7*d* of the conduit 7, and fed to a feed mechanism (not shown) of the spinning unit 2. As shown in FIG. 1, the sliver 11 enters the body 1 at a point A and comes out of the body 1 at a point B.

As described in the introductory portion of the specification, in the case of 20 counts yarn, the sliver 11 requires about 6 minutes to travel from the point A to B, and during this travel the sliver 11 would be subject to undesirable functions of heat produced in the interior of the frame body 1 due to the high speed rotation of the spinning units 2.

Figure 2:
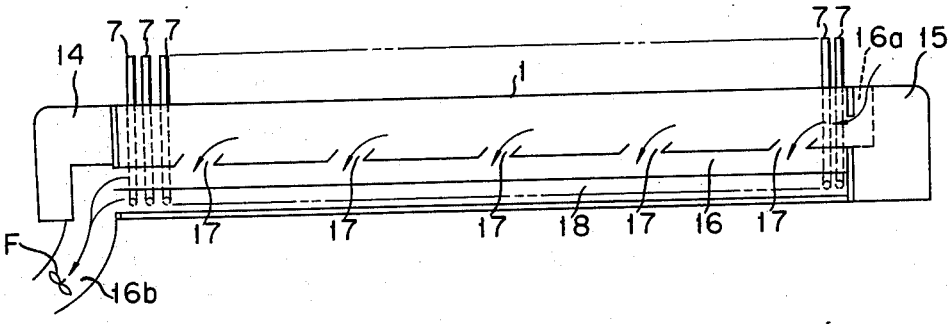
FIG. 2 is a view diagrammatically illustrating a construction of a ringless spinning frame according to the invention.

According to the invention, as shown in FIG. 2, in order to avoid the bad influences from the heat stored in the frame body interior, the spinning frame is provided with means disposed near the guide conduits 7 within the spinning frame body 1 for preventing the heat produced by the spinning units 2 from being transmitted to the guide conduits 7 within the spinning frame body 1. This heat transfer preventing means comprises a duct 16 extending within the lower part of the interior of the body 1 between a drive head 14 and a gear head 15. The duct 16 passes near the guide conduits 7 and the heat transfer preventing means has an air inlet 16*a* on the side of the gear head 15 and an air outlet 16*b* on the side of the drive head 14. The inlet 16*a* opens into the interior of the body 1 and is in fluid communication with the interior of the body 1, while the outlet 16*b* is in an open end of the duct 16 opening into the exterior of the body. A plurality of apertures 17 are provided in the duct 16 along the length thereof so that heated air within the body interior is inhaled through the apertures 17 into the duct 16 and thereby driven out of the body interior by an air current flowing from the inlet 16*a* to the outlet 16*b*. A fan F is provided in the duct on the side of the outlet 16*b* to carry out an induced draft of the heated air. However, it is noted that the fan may be installed at the inlet side or at both the inlet and outlet sides.

Below the duct 16, an exhaust duct 18 for the rotors of the spinning units 2 is mounted in parallel relationship therewith. In this embodiment, the exhaust duct 18 is associated with the outlet 16*b* of the duct 16 and the fan F also serves to exhaust air from the spinning unit rotors. It is desirable that the areas of the apertures 17 change according to the respective distances thereof from the outlet 16*b* to obtain a uniform thermal distribution in the body interior.

It will also be understood that the duct 16 may flow an air current from the drive head side toward the gear head side.

Figure 3:
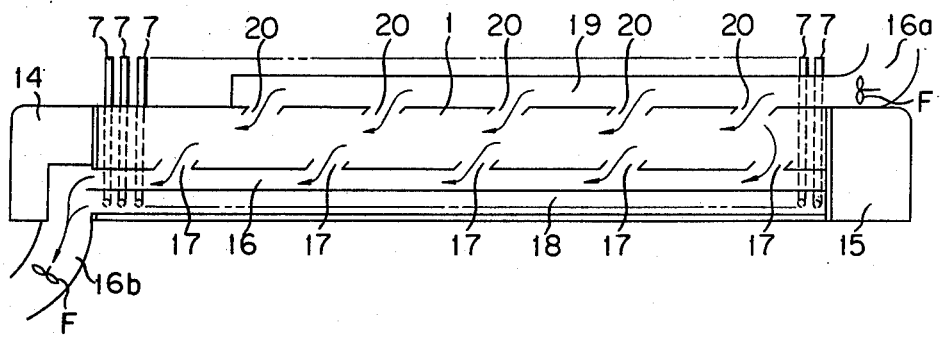
FIG. 3 is a view corresponding to FIG. 2, but showing a modification.

In FIG. 3, an additional air supply duct 19 is arranged on the spinning frame body 1. The duct 19 is provided with a plurality of apertures 20 through which it is in fluid communication with the interior of the spinning frame body 1. This arrangement provides a highly uniform ventilation along the overall length of the spinning frame body interior.

During operation of the ringless spinning frame, the fan F is driven to inhale cold air through the inlet 16*a* and to cause the hot air within the interior of the body 1 to flow into the duct 16 through the apertures 17, while being cooled by the inhaled cold ir, and to be exhausted through the outlet 16*b*, thus preventing the guide conduits 7 from being heated by the hot air within the spinning frame body interior. Since the hot air within the spinning frame body interior is forcibly discharged therefrom together with fly wastes, the cleaning cycle of the spinning frame can be highly prolonged.

Figure 5:
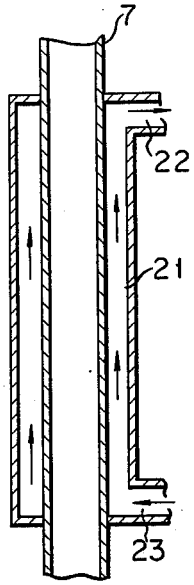
FIG. 5 is a longitudinal section of a heat transfer preventing means of the invention shown in FIG. 4.
Figure 4:
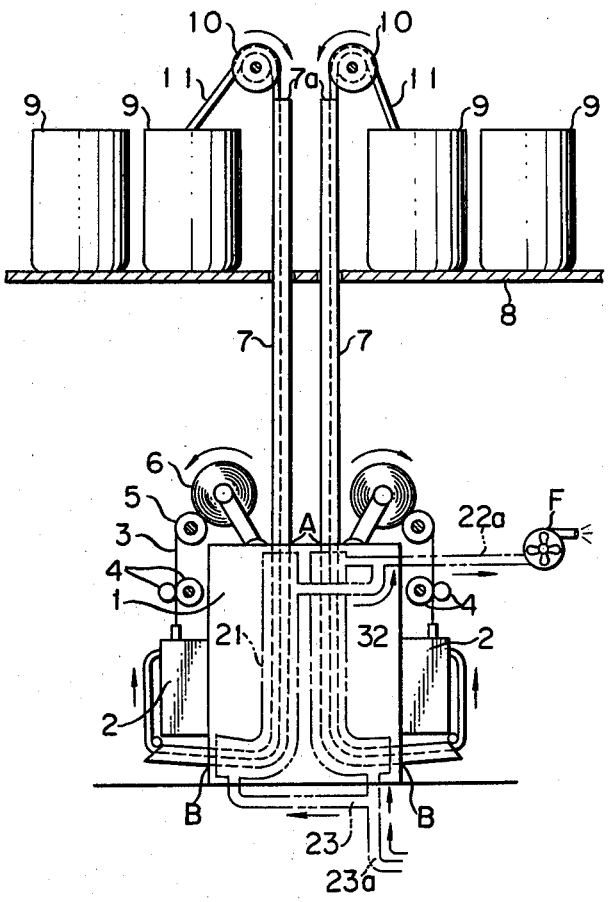
FIG. 4 is a schematic side view of a ringless spinning frame of the invention, showing a further modification.

In the embodiments shown in FIGS. 4, 5 nd 6, the heat transfer preventing means comprises a plurality of annular fluid passageways or pipes 21 sealingly mounted around the associated sliver guide conduits 7. The pipes 21 are formed at the upper portions thereof with fluid outlets 22 and at the lower portions thereof with inlets 23, the outlets and inlets being connected respectively to corresponding headers 22*a* and 23*a*. The header 23*a* opens into the atmosphere surrounding the frame body 1 and the header 22*a* is connected to a suction fan F, whereby the cold air from the atmosphere is forcibly caused to flow through the pipes 21. Therefore, even if the temperature of the frame body interior is raised, that of the outer surface of the sliver guide conduit 7 will be maintained in a level substantially equal to that of the exterior of the spinning frame body 1. That is, the heat produced by the spinning units is not transferred to the sliver guide conduits 7.

Figure 6:
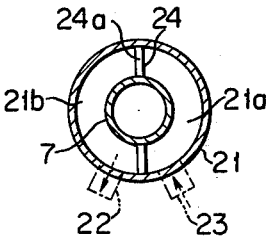
FIG. 6 is a cross section of another heat transfer preventing means according to the invention.

In the embodiment of FIG. 6, the outlet and inlet 22 and 23 are provided in the same lower or upper end portion of the passageway 21. In this case, to allow the cold air to circulate through the overall length of the passageway 21, a partition 24 is provided within the passageway to divide it into chambers 21*a* and 21*b*. The cold air enters the chamber 21*a* through the inlet 23 and, in the case where, for example, both the outlet and inlet 22 and 23 are provided in the lower end portion, moves upwards along the partition 24 and clears an upper edge 24*a* of the partition to enter the chamber 21*b* and then moves downwards along the partition 24 and out of the passageway 21 through the outlet.

Figure 7:
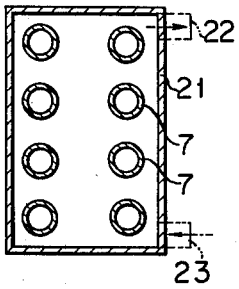
FIG. 7 is a view corresponding to FIG. 6, showing still another heat transfer preventing means.

Although one fluid pipe 21 is provided for each sliver guide conduit 7 in the embodiments shown in FIGS. 4 to 6, an arrangement will be easily anticipated by those skilled in the art, wherein two or more guide conduits 7 extend through a common fluid passageway 21 provided within the body interior. This arrangement is shown in FIG. 7.

It is to be noted that a liquid, such for example as water, may be used, instead of the cold air surrounding the spinning frame body 1, for the embodiments shown in FIGS. 4 to 7.

Figure 8:
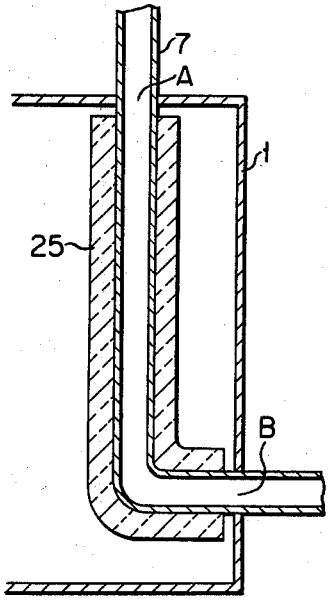
FIG. 8 is a view corresponding to FIG. 5, but showing a still further modification.

In an embodiment shown in FIG. 8, a heat transfer preventing means consists of heat insulating member 25 arranged about at least a major portion of the corresponding guide conduit 7. Therefore, the heat transfer to the guide conduit can be prevented by the insulating member 25. Similar to the embodiment shown in FIG. 7, two or more guide conduits 7 may be surrounded by a common insulating member 25.

From the foregoing, it is understood that, according to the invention, not only the sliver guide conduit is not heated due to the heat produced by the spinning units, but there is substantially no temperature difference between the outer and inner surfaces of the sliver guide conduit. Therefore, all undesirable thermal influences to the sliver and the spinning frame can be excluded.

What we claim is:

1. In a ringless spinning frame comprising a spinning frame body; a plurality of spinning units mounted on opposite sides of said spinning frame body; a plurality of sliver cans disposed above said spinning frame body; and a plurality of sliver guide conduits, one each disposed between each of said sliver cans and the respective corresponding said spinning unit, each said guide conduit extending downwardly into the interior of said spinning frame body and passing therethrough along the back and bottom of the said respective corresponding spinning unit and opening exteriorly of said spinning frame body at a position below the bottom of the said respective corresponding spinning unit; the improvement comprising: means, positioned closely adjacent each of said guide conduits within said spinning frame body, for preventing heat produced by said spinning units from being transferred to said guide conduits within said spinning frame body, said heat transfer preventing means comprising duct means disposed closely adjacent said guide conduits within said spinning frame body and extending therealong, a plurality of apertures connecting said duct means with said interior of said spinning frame body, said apertures being spaced along the length of said duct means, air inlet and outlet means respectively arranged on opposite end portions of said spinning frame body in fluid communication with said interior of said spinning frame body, for passing cold air present exterior of said body into said interior of said body through the inlet means, through said apertures into said means and outwardly through said outlet duct means, and for thereby withdrawing from said interior of said body the heat produced by said spinning units, fan means, positioned in at least one of said inlet and outlet means, for forcibly withdrawing said heat produced by said spinning units, separate duct means positioned on the top of said spinning frame body and extending therealong, a plurality of apertures connecting said separate duct means with said interior of said spinning frame body, and one of the air inlet and outlet means being connected to an end portion of said separate duct means spaced away from the other of said air inlet and outlet means.

2. In a ringless spinning frame comprising a spinning frame body; a plurality of spinning units mounted on opposite sides of said spinning frame body; a plurality of sliver cans disposed above said spinning frame body; and a plurality of sliver guide conduits, one each disposed between each of said sliver cans and the respective corresponding said spinning unit, each said guide conduit extending downwardly into the interior of said spinning frame body and passing therethrough along the back and bottom of the said respective corresponding spinning unit and opening exteriorly of said spinning frame body at a position below the bottom of the said respective corresponding spinning unit; the improvement comprising: means, positioned closely adjacent each of said guide conduits within said spinning frame body, for preventing heat produced by said spinning units from being transferred to said guide conduits within said spinning frame body, said heat transfer preventing means comprising duct means disposed closely adjacent said guide conduits within said spinning frame body and extending therealong, a plurality of apertures connecting said duct means with said interior of said spinning frame body, said apertures being spaced along the length of said duct means, air inlet and outlet means respectively arranged on opposite end portions of said spinning frame body in fluid communication with said interior of said spinning frame body, for passing cold air present exterior of said body into said interior of said body through the inlet means, through said apertures into said means and outwardly through said outlet duct means, and for thereby withdrawing from said interior of said body the heat produced by said spinning units, and fan means, positioned in at least one of said inlet and outlet means, for forcibly withdrawing said heat produced by said spinning units; and further comprising a duct for ventilating rotors of said spinning units, said duct means being disposed adjacent and above said duct, both said duct and said duct means being connected to said air outlet means, said fan means being positioned in said air outlet means.

3. In a ringless spinning frame comprising a spinning frame body; a plurality of spinning units mounted on opposite sides of said spinning frame body; a plurality of sliver cans disposed above said spinning frame body; and a plurality of sliver guide conduits, one each disposed between each of said sliver cans and the respective corresponding said spinning unit, each said guide conduit extending downwardly into the interior of said spinning frame body and passing therethrough along the back and bottom of the said respective corresponding spinning unit and opening exteriorly of said spinning frame body at a position below the bottom of the said respective corresponding spinning unit; the improvement comprising: means, positioned closely adjacent each of said guide conduits within said spinning frame body, for preventing heat produced by said spinning units from being transferred to said guide conduits within said spinning frame body, said heat transfer preventing means comprising a plurality of fluid passageways arranged around the corresponding said guide conduits within said interior of said spinning frame body, each said passageway having a fluid inlet and outlet in fluid communication with the exterior of the said spinning frame body to allow a fluid to flow through a said passageway.

4. The improvement claimed in claim 3, wherein said inlet and outlet are respectively positioned in a lower and an upper portion of said passageway.

5. The improvement claimed in claim 3, wherein said fluid comprises air present at the exterior of said spinning frame body.

6. The improvement claimed in claim 3, wherein both said inlet and outlet are positioned in one of the upper and lower end portions of said passageway, and further comprising a partition member positioned within said passageway and dividing said passageway into two compartments, said two compartments being in fluid communication with each other at the other of the upper and lower end portions of said passageway, thereby allowing circulation of said fluid through said passageway.

7. The improvement claimed in claim 3, wherein each said passageway surrounds a plurality of said guide conduits within said interior of said spinning frame body.

8. In a ringless spinning frame comprising a spinning frame body; a plurality of spinning units mounted on opposite sides of said spinning frame body; a plurality of sliver cans disposed above said spinning frame body; and a plurality of sliver guide conduits, one each disposed between each of said sliver cans and the respective corresponding said spinning unit, each said guide conduit extending downwardly into the interior of said spinning frame body and passing therethrough along the back and bottom of the said respective corresponding spinning unit and opening exteriorly of said spinning frame body at a position below the bottom of the said respective corresponding spinning unit; the improvement comprising: means, positioned closely adjacent each of said guide conduits within said spinning frame body, for preventing heat produced by said spinning units from being transferred to said guide conduits within said spinning frame body, said heat transfer preventing means comprising a plurality of heat insulating members, one each surrounding a respective corresponding said guide conduit within said interior of said spinning frame body.

* * * * *